United States Patent [19]

Arsenault

[11] 4,199,870

[45] Apr. 29, 1980

[54] METHOD FOR PREVENTING STICKER MARKS ON ARCHITECTURAL GRADE PLYWOOD AND LUMBER

[75] Inventor: Robert D. Arsenault, Wexford, Pa.

[73] Assignee: Koppers Company, Inc., Pittsburgh, Pa.

[21] Appl. No.: 867,761

[22] Filed: Jan. 9, 1978

[51] Int. Cl.[2] ..... F26B 3/04

[52] U.S. Cl. ..... 34/24; 34/38; 34/9.5; 34/13.8; 414/110

[58] Field of Search ..... 34/9.5, 13.4, 13.8, 34/24, 38, 148; 214/10.5 R; 140/107

[56] References Cited

U.S. PATENT DOCUMENTS

| | | | |
|---|---|---|---|
| 753,904 | 3/1904 | McFarland | 214/10.5 R |
| 1,319,931 | 10/1919 | Sommerlatte | 214/10.5 R |
| 1,549,138 | 8/1925 | Maudlin | 214/10.5 R |
| 2,679,111 | 5/1954 | Leischner | 34/9.5 |
| 3,659,352 | 5/1972 | Cook | 34/191 |
| 4,049,224 | 9/1977 | Wener et al. | 140/107 |

*Primary Examiner*—Larry I. Schwartz

*Attorney, Agent, or Firm*—Thomas L. Sivak; Oscar B. Brumback

[57] ABSTRACT

Herein disclosed is an improved method of kiln drying architectural grade plywood and lumber which has been treated with a water borne agent. The improved method utilizes coated wire mesh as the kiln stickers. Use of the coated wire mesh stickers greatly reduces the incidence of sticker marks on the decorative faces of the plywood and lumber.

3 Claims, 1 Drawing Figure

Fig. I.
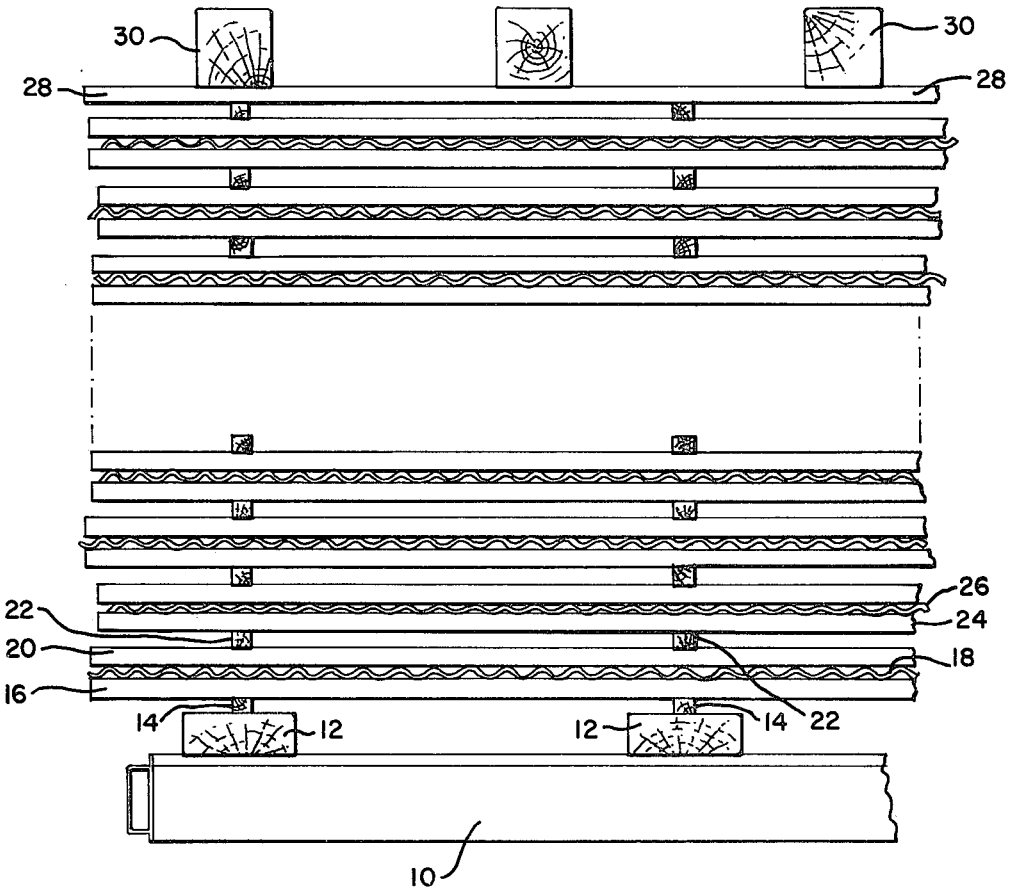

METHOD FOR PREVENTING STICKER MARKS ON ARCHITECTURAL GRADE PLYWOOD AND LUMBER

BACKGROUND OF THE INVENTION

1. Field of the Invention

This invention relates to the kiln drying of architectural grade plywood and lumber and, more particularly, to a method whereby the sticker marks associated with traditional kiln drying methods are either eliminated or greatly reduced.

2. Brief Description of the Prior Art

In conventional kiln drying strips of wood generally ⅜ inch or thicker by approximately ¾ inch wide are used as stickers to separate layers of plywood or lumber to permit the proper circulation of air over the faces and backs of the plywood or lumber. Often architectural grade plywood or lumber is treated with a water-borne agent such as a fire retardant to impart to it certain properties such as flame resistance. Use of the traditional stickers in the kiln drying of water-borne treated lumber often damages the finished faces of the plywood or lumber in that streaks or discolorations appear in the surface. If these faces are the decorative faces of the lumber or plywood, the streaks or discolorations must be removed to provide a uniform and acceptable surface. The removal of these streaks and discolorations involve considerable expense in both time and machinery which causes a resultant increase in the cost of the final product.

It is an object of the present invention to eliminate or minimize the streaks or discolorations in the decorative surfaces of lumber and plywood which result from conventional kiln drying methods.

SUMMARY OF THE INVENTION

The present invention overcomes the foregoing problems of the prior art by providing a method of kiln drying plywood or lumber which has been treated by a water-borne agent in which a coated wire mesh is used in place of conventional stickers. The coated wire mesh is placed in the space between the faces of the plywood or lumber to be dried. The stack using the coated wire mesh stickers is formed on a kiln tram and placed in the kiln to be dried. The stack is then left in the kiln for a predetermined time at predetermined temperatures and then removed. The use of the present invention results in kiln dried lumber or plywood having superior quality decorative faces requiring little or no refinishing prior to use.

DESCRIPTION OF THE DRAWING

FIG. 1 is a side elevational view of a stack of lumber to be kiln dried in accordance with the present invention.

DESCRIPTION OF THE PREFERRED EMBODIMENT

Referring to the FIGURE, a stack of lumber to be kiln dried in accordance with the present invention is formed on a conventional flat tram 10. The tram is approximately 8 feet wide and 16 feet long. Stringers 12 are formed from 2 by 6 lumber cut in 8-foot lengths. The stringers 12 are placed on the flat tram at 2-foot intervals. In the preferred embodiment described, the lumber is being treated with a water-borne flame retardant and is to be used with only one face exposed or decorative. It will be understood by one skilled in the art that the coated wire mesh stickers of the present invention could be used to separate the faces and backs of the lumber if both the face and back were to be decorative. It will be further understood by one skilled in the art that the coated wire mesh stickers of the present invention can be used to separate the layers of lumber when the charge of lumber is placed in a cylinder for the water-borne treatment.

Wood stickers 14 of ¾ inch by 1½ inches cut in 8-foot lengths are placed on the centers of each of the bottom stringers. The lumber to be dried 16, in this embodiment redwood architectural grade lumber, is placed poorest side down on stickers 14. The coated wire mesh stickers 18, 4 foot wide and 8 foot long, are then placed over the good side of the redwood lumber with the 8-foot length parallel to stickers 14. Coated wire mesh stickers 18 have a mesh of 2 inches, are made of wire ¾ inch in diameter. The mesh is coated with vinyl. A second layer 20 of redwood lumber was placed good face down against wire mesh stickers 18. Wood stickers 22 are then placed over the back of layer 20 and aligned with stickers 14. A third layer of lumber 24 is then placed with the back down on wood stickers 22 and vinyl coated 4 foot by 8 foot wire mesh stickers 26 placed over the good or decorative face of layer 24.

This sequence of good or decorative faces separated by the vinyl coated wire mesh sticker and the back faces separated by conventional wooden strip stickers was continued until 39 layers of boards are on tram 10. The completed tram is covered with a layer of plywood cover boards 28 and weighted with 4 inch by 4 inch oak 30. The completed tram is then moved into the kiln and dried in accordance with the following cycle:

| Hours | Dry Bulb | Wet Bulb |
|---|---|---|
| 19.5 | 100° F. | 100° F. |
| 24.0 | 110° F. | 105° F. |
| 24.0 | 110° F. | 100° F. |
| 24.0 | 115° F. | 100° F. |
| 24.0 | 120° F. | 105° F. |
| 48.0 | 130° F. | 113° F. |

The dry bulb temperature is then raised in 10 degree increments per hour to a temperature of 200° F. The lumber is cured for 13 hours at 200° F. with the wet bulb off.

Approximately 97% of the lumber treated in accordance with the present invention had decorative faces satisfactory for immediate use with no further surface preparation. There is virtually no surface residue or mottling present. In addition, all boards were in satisfactory physical condition not being checked, cupped, warped or twisted.

While I have described certain preferred embodiments of the present invention, it will be understood it may otherwise be embodied within the scope of the following claims.

What is claimed:

1. In a method of kiln drying a wood product which has been treated by a water-borne agent including the steps of layering the wood on a kiln tram, providing spaces between said layers of wood on said tram and placing the loaded tram in a kiln for drying, the improvement comprising the step of:

separating the faces of said wood from one another by means of coated wire mesh wherein said coated wire mesh has a mesh opening of approximately 2 inches and is convoluting $\frac{3}{4}$ inch in diameter so that said spaces between said layers of wood is a minimum of $\frac{3}{8}$ inch.

2. The method of claim 1 wherein the wire mesh is coated with vinyl.

3. In a method of kiln drying a wood product which has been treated by a water-borne agent including the steps of layering the wood on a kiln tram, providing spaces between said layers of wood on said tram and placing the loaded tram in a kiln for drying, the improvement comprising the step of:

separating the decorative faces of said layers of wood by means of a coated wire mesh wherein said coated wire mesh has an opening of approximately 2 inches, and is convoluting so that said spaces between said layers of wood is a minimum of $\frac{3}{8}$ inches.

* * * * *